US009611856B2

(12) United States Patent
Cheng et al.

(10) Patent No.: US 9,611,856 B2
(45) Date of Patent: Apr. 4, 2017

(54) MIXED THEORETICAL AND DISCRETE SENSORLESS CONVERTER FOR PUMP DIFFERENTIAL PRESSURE AND FLOW MONITORING

(71) Applicant: Fluid Handling LLC., Morton Grove, IL (US)

(72) Inventors: Andrew A. Cheng, Wilmette, IL (US); Graham A. Scott, Prospect Heights, IL (US); James J. Gu, Buffalo Grove, IL (US)

(73) Assignee: Fluid Handling LLC, Morton Grove, IL (US)

( * ) Notice: Subject to any disclaimer, the term of this patent is extended or adjusted under 35 U.S.C. 154(b) by 375 days.

(21) Appl. No.: 14/187,817

(22) Filed: Feb. 24, 2014

(65) Prior Publication Data

US 2014/0288716 A1 Sep. 25, 2014

Related U.S. Application Data

(60) Provisional application No. 61/803,258, filed on Mar. 19, 2013.

(51) Int. Cl.
*G05B 19/00* (2006.01)
*F04D 15/00* (2006.01)

(52) U.S. Cl.
CPC ..... *F04D 15/0066* (2013.01); *F04D 15/0088* (2013.01)

(58) Field of Classification Search
None
See application file for complete search history.

(56) References Cited

U.S. PATENT DOCUMENTS 5,318,409 A 6/1994 London et al.
5,615,996 A 4/1997 Suzuki et al.
5,704,339 A * 1/1998 Choe ..... F01N 3/0842 123/674
5,817,950 A 10/1998 Wiklund et al.
6,142,228 A 11/2000 Jogi et al.
(Continued)

FOREIGN PATENT DOCUMENTS

WO 2005115539 12/2005

*Primary Examiner* — Philip Wang
(74) *Attorney, Agent, or Firm* — Ware, Fressola, Maguire & Barber LLP

(57) ABSTRACT

The present invention provides apparatus featuring a signal processor or processing module that may be configured at least to: process signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique; and determine equivalent hydronic system characteristics associated with the pump differential pressure and flow rate to their corresponding motor power and speed reconstructed and remapped by using a discrete numerical approach, based at least partly on the signaling received. The signal processor or processing module may provide corresponding signaling containing information about the system pumping flow rate and pressure determined.

40 Claims, 4 Drawing Sheets

Pump and system characteristics curves and the pressures equilibrium point at the intersection.

(56) References Cited

U.S. PATENT DOCUMENTS

| | | | | |
|---|---|---|---|---|
| 6,280,408 | B1 * | 8/2001 | Sipin | A61M 5/1483 604/65 |
| 6,332,463 | B1 | 12/2001 | Farrugia et al. | |
| 6,532,423 | B2 | 3/2003 | Chen et al. | |
| 6,918,307 | B2 * | 7/2005 | Ohlsson | F04D 15/0088 415/17 |
| 6,991,595 | B2 | 1/2006 | Burke et al. | |
| 7,033,147 | B2 | 4/2006 | Yanai et al. | |
| 7,036,559 | B2 | 5/2006 | Stanimirovic | |
| 7,163,001 | B2 | 1/2007 | Jung et al. | |
| 7,341,201 | B2 | 3/2008 | Stanimirovic | |
| 7,668,694 | B2 | 2/2010 | Anderson et al. | |
| 7,945,411 | B2 | 5/2011 | Kernan et al. | |
| 8,024,161 | B2 | 9/2011 | Pekar et al. | |
| 8,065,110 | B2 | 11/2011 | Golinveaux et al. | |
| 8,140,274 | B2 | 3/2012 | Gagel et al. | |
| 8,235,776 | B2 | 8/2012 | Stanimirovic | |
| 8,353,289 | B2 | 1/2013 | Farrugia et al. | |
| 8,700,221 | B2 | 4/2014 | Cheng et al. | |
| 2007/0212210 | A1 | 9/2007 | Kernan et al. | |
| 2009/0094002 | A1 * | 4/2009 | Kallenbach | G06F 17/50 703/1 |
| 2010/0275678 | A1 * | 11/2010 | Herzog | F04B 11/0058 73/61.56 |
| 2011/0223038 | A1 | 9/2011 | Ogawa et al. | |
| 2011/0313517 | A1 | 12/2011 | Reichenbach et al. | |
| 2012/0173027 | A1 | 7/2012 | Cheng et al. | |
| 2012/0251340 | A1 * | 10/2012 | Ahonen | F04D 15/0088 417/53 |
| 2014/0046605 | A1 * | 2/2014 | McHugh | G01M 3/3254 702/51 |

* cited by examiner

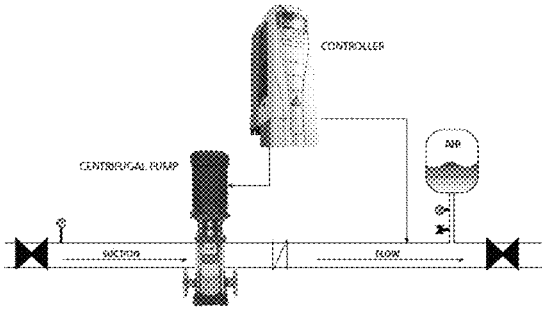
Figure 1: A hydronic pumping system.
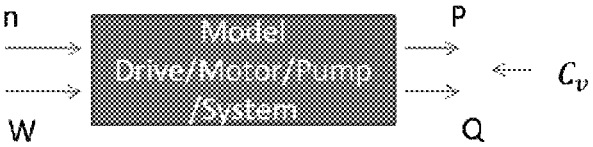
Figure 2. Conversion of the system pressure and flow rate from motor power and speed with a pumping hydronic system.
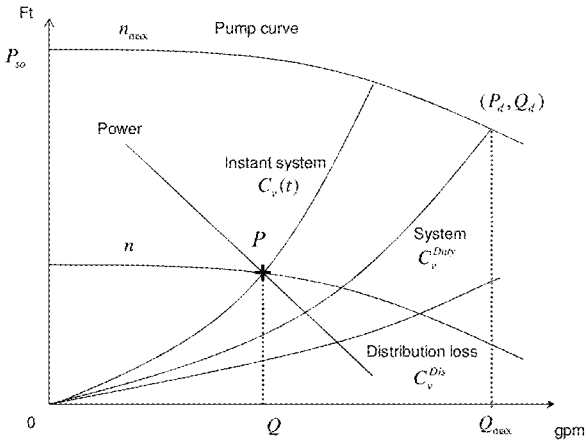
Figure 3. Pump and system characteristics curves and the pressures equilibrium point at the intersection.

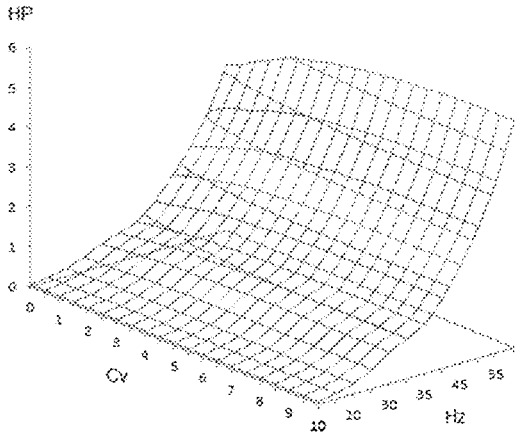
Figure 4. 3D discrete distribution functions of motor power with respect to motor speed and equivalent system characteristics, respectively.

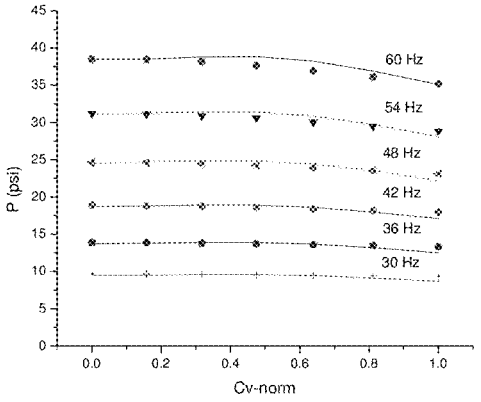
Fig. 5a
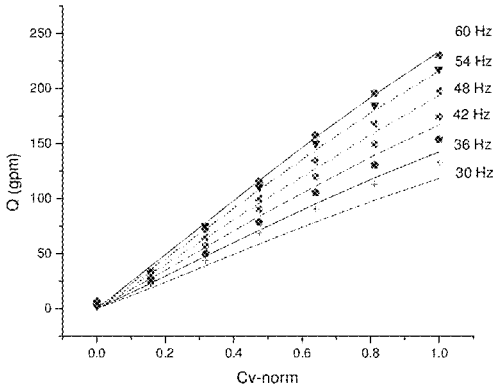
Fig. 5b
Figure 5

Apparatus 10

Signal processor or processing module 10a configured at least to:

process signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique;

determine equivalent hydronic system characteristics associated with the pump differential pressure and flow rate to their corresponding motor power and speed reconstructed and remapped by using a discrete numerical approach, based at least partly on the signaling processed; and/or provide corresponding signaling containing information about the equivalent hydronic system characteristics determined.

Other signal processor circuits or components 10b that do not form part of the underlying invention, e.g., including input/output modules, one or more memory modules, data, address and control busing architecture, etc.

Figure 6

MIXED THEORETICAL AND DISCRETE SENSORLESS CONVERTER FOR PUMP DIFFERENTIAL PRESSURE AND FLOW MONITORING

CROSS REFERENCE TO RELATED APPLICATION

This application claims benefit to provisional patent application No. 61/803,258, filed 19 Mar. 2013, which is hereby incorporated by reference in its entirety.

This application is also related to a family of technologies disclosed in the following applications:

- U.S. application Ser. No. 12/982,289, filed 30 Dec. 2010, entitled "Method and apparatus for pump control using varying equivalent system characteristic curve, AKA an adaptive control curve," which issued as U.S. Pat. No. 8,700,221;
- U.S. application Ser. No. 13/717,086, filed 17 Dec. 2012, entitled "Dynamic linear control methods and apparatus for variable speed pump control," which claims benefit to U.S. provisional application No. 61/576,737, filed 16 Dec. 2011;
- U.S. application Ser. No. 14/091,795, filed 27 Nov. 2013, entitled "3D sensorless conversion method and apparatus;" and
- U.S. provisional application No. 61/858,237, filed 25 Jul. 2013, entitled "Sensorless adaptive pump control with self-calibration apparatus for hydronic pumping system;"

which are all assigned to the assignee of the instant patent application, and all incorporated by reference in their entirety.

The present invention builds on the family of technologies disclosed in the aforementioned related applications.

BACKGROUND OF THE INVENTION

1. Field of the Invention

The present invention relates to a technique for controlling the operation of a pump; and more particularly, the present invention relates to a method and apparatus for controlling and/or monitoring a pump, e.g., including for domestic and commercial heating or cooling water systems.

2. Brief Description of Related Art

In previous works for a hydronics pumping system sensorless control and monitoring by one or more of the inventors of the present application, a 3D sensorless converter was developed to obtain the system flow and pump differential pressure associated with any unknown hydronic pumping system, consistent with that disclosed in the aforementioned patent application Ser. No. 14/091,795. With the 3D sensorless approach, the system pressure and flow rate can be resolved directly from any pair of motor readout signals, such as speed, current, torque, power, and so on so forth, with high conversion accuracy. Consistent with that disclosed in the aforementioned provisional patent application Ser. No. 61/858,237, self-calibration sensorless adaptive pump control methods for hydronic pumping control systems were developed as well based upon the aforementioned 3D sensorless converter and adaptive control approaches disclosed in the aforementioned patent application Ser. Nos. 12/982,286 and 13/717,086. Following the approach, the adaptive pressure set point pumping control can be achieved with respect to dynamic hydronic system variation without a need for any pressure or flow sensors for pumping control.

Sensorless calibration instrumentation and data acquisition are always an interesting part of discussions regarding sensorless applications and not easy to be achieved for some applications due to lack of a pressure sensor or a flow meter in field, not to mention wiring issues. For some of the hydronic pumping applications where the flow rate monitoring is not very critical for pump control, however, a theoretical and discrete model without a need for instrumentation calibration may be easier to be used in the field.

There are several approaches that may be used for the sensorless conversion, including the discrete models calibrated with the pump and system hydronic data together with the numerical solutions. By way of example, see patent application Ser. No. 14/091,795, filed 27 Nov. 2013, entitled, "3D Sensorless Conversion Means and Apparatus for Pump Differential Pressure and Flow," which is hereby incorporated by reference in its entirety. The discrete sensorless modeling approaches are simple and straight forward. The conversion accuracy may be preserved well with <5-10% margin of error if the conversion algorithm is well formed and calibrated properly. On the other hand, the theoretical sensorless model approaches may be formulated as well for some simple and easy pump control applications where there is no accurate flow and pressure requested for pump control and there may be the lack of calibration sensors. As a tradeoff, the flow and pressure conversion accuracy may have as low as a >10-15% margin of error. The conversion accuracy may be deteriorated very rapidly at low speed.

By way of example, FIG. 1 shows a water booster pumping system that is known in the art. FIG. 2 schematically shows the energy conversion between pump differential pressure and the flow rate associated with the equivalent hydronic system characteristics at the discharge section of a pump and the motor power and speed at the other end of a motor drive at any time. FIG. 3 schematically presents pump and system characteristics curves and an equilibrium point associated with pump differential pressure and system pressure.

Recently, issues regarding energy saving and environmental protection in such pumping systems have been addressed dramatically. Increasingly more attention is being paid to hydronic pump control applications, including pump controls for domestic and commercial heating and cooling water pumping or circulating systems, water booster pumping systems, and so forth, like those shown in FIG. 1 with their characteristics that may be dynamic and unknown in nature. For example, to reduce energy consumption and operation costs, the aforementioned adaptive control approaches have been proposed.

SUMMARY OF THE INVENTION

In summary, according to the present invention, a mixed theoretical and discrete sensorless converter for corresponding pump differential pressure and system flow rate at a given pair of motor power and speed is provided by utilizing pump and system characteristics equations together with a discrete system power inversion equation. The sensorless converter means developed can be used for most hydronic pumping control and monitoring applications with satisfactory accuracy without a need for instrumentation calibration.

By way of example, an equilibrium point of pump differential pressure and system pressure may be formulated in a hydronic domain first by utilizing pump and system characteristics curves equations, which yield system pressure and flow rate at any load and time. Equivalent hydronic system characteristics associated with the pump differential pressure and flow rate to their corresponding motor power and speed reconstructed and remapped by using a discrete numerical approach may be then introduced. The pump differential pressure and flow rate by the means or technique disclosed herein can be resolved with more accuracy without a need for instrumentation calibration.

PARTICULAR EMBODIMENTS

According to some embodiments, the present invention may include, or take the form of, apparatus featuring a signal processor or processing module configured at least to: process signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique; and determine equivalent hydronic system characteristics associated with the pump differential pressure and flow rate to their corresponding motor power and speed reconstructed and remapped by using a discrete numerical approach, based at least partly on the signaling processed.

Embodiments of the present invention may also include one or more of the following features:

The signal processor or processing module may be configured to provide corresponding signaling containing information about the equivalent hydronic system characteristics determined, e.g., including the pump differential pressure and flow rate for monitoring.

The corresponding signaling may contain information used to control or adapt the pumping hydronic system.

The signal processor or processing module may be configured to receive motor power and speed readout signaling containing information about motor power and speed and convert the equivalent hydronic system characteristics from the motor power and speed readout signaling received.

The signal processor or processing module may be configured to balance the pump differential pressure and flow rate at the equilibrium point of a pump differential pressure curve at a given speed with the equivalent hydronic system characteristics at a given load.

The signal processor or processing module may be configured to use a pump curve equation based at least partly on a pump curve model which was developed based upon a pump characteristic equation at any motor speed and system flow rate which may be represented approximately by a polynomial function of $P=f_p(Q,n)$ based upon a full speed characteristics curve and affinity laws. By way of example, the polynomial function may include a second order polynomial function of $$P=\left(P_{so}+\frac{P_d-P_{so}}{Q_d^2}Q^2\right)\left(\frac{n}{n_{max}}\right)^2, \tag{1}$$

where $P_{so}$ is a pump shutoff pressure at motor full speed, and $P_d$ and $Q_d$ are a pump pressure and a flow rate at a duty point. Alternatively, the polynomial function may also include a third or a fourth order polynomial function to represent a pump curve equation. The signal processor or processing module may also be configured to re-derive the pump curve equation accordingly.

The signal processor or processing module may be configured to use an equivalent hydronic system characteristics curve equation that includes a flow equation of $C_v=Q/\sqrt{P}$, or at least some of its approximations.

The signal processor or processing module may be configured to determine a pressure equilibrium point that includes an intersection of a pump curve as well as a system curve.

The pressure equilibrium point for the system pressure and flow rate at any motor speed and power may be based at least partly on a second order pump curve approximation.

The signal processor or processing module may be configured to use a discrete conversion to an equivalent system characteristics coefficient from the corresponding motor power and speed that includes an inversely remapped discrete function of $\hat{w}$ from a motor power distribution of W with respect to motor speed and an equivalent system curve based upon their corresponding calibration pump and motor data plotted.

The signal processor or processing module may be configured to use a discrete conversion of remapping and reconstruction that includes one or more 3D discrete numerical remapping methods, including 2D interpolations or 2D Splines.

The signal processor or processing module may be configured to use a discrete conversion of remapping and reconstruction that includes one or more 2D or 3D discrete or numerical inversion methods, including 1D or 2D direct inversion, minimizations or simplex.

The signal processor or processing module may be configured to use for the pumping hydronic system one or more close loop or open loop hydronic pumping systems, including primary pumping systems, secondary pumping systems, water circulating systems, and pressure booster systems.

The pumping hydronic system may include a single zone or multiple zones.

The signal processor or processing module may be configured to use pump calibration data for a close loop hydronic system that includes pump differential pressure and flow rate data.

The pump calibration data may include either system pressure data, or pump discharge section pressure and corresponding flow rate data.

The signal processor or processing module may be configured to use pump calibration data for an open loop hydronic system that includes the pump differential pressure or system pressure and flow rate with respect to corresponding motor data.

For an open loop system with a static suction pressure, the signal processor or processing module may be configured to receive associated signaling containing information about system pressure and flow rate data obtained directly in the field.

For an open loop system with a varying suction pressure, the signal processor or processing module may be configured to receive associated signaling from one pressure sensor at a pump suction side or a differential pressure sensor at the pump that may be used to calibrate pressure and flow rate contributions from suction pressure.

The signal processor or processing module may be configured to use measured motor data that includes some pair of potential motor electrical or mechanical readout signals, including motor speed, current, torque, or power.

The signal processor or processing module may be configured to process hydronic signals that include system pressure, pump differential pressure, zone pressures, system flow rates, or zone flow rates.

The signaling received may contain information related to a pump that may include a single pump, a circulator, a group of parallel ganged pumps or circulators, a group of serial ganged pumps or circulators, or their combinations.

The apparatus includes, or forms part of, the pump hydronic system.

The corresponding signaling may be provided for systems flow regulation that includes manual or automatic control valves, manual or automatic control circulators, or some combination thereof.

The signal processor or processing module may be configured to determine a pump characteristic curve based at least partly on a pump characteristics equation, as follows:

$$P = \left(P_{so} + \frac{P_d - P_{so}}{Q_d^2} Q^2\right)\left(\frac{n}{n_{max}}\right)^2, \tag{1}$$

where $P_{so}$ is a pump shutoff pressure at motor full speed, and $P_d$ and $Q_d$ are a pump pressure and a flow rate at a duty point.

The signal processor or processing module may be configured to determine an equivalent hydronic system characteristics or dynamic friction coefficient of $C_v$, based at least partly on a flow equation, as follows:

$$C_v = Q\sqrt{P}$$

The signal processor or processing module may be configured to determine a pressure equilibrium point at an intersection of the pump and system characteristic curves in the hydronic domain based at least partly on solving equations, as follows:

$$P(n, C_v) = P_{so}\left(\left(\frac{n_{max}}{n}\right)^2 - (P_d - P_{so})\left(\frac{C_v}{Q_d}\right)^2\right)^{-1} \tag{2}$$

$$Q(n, C_v) = C_v\left(P_{so}\left(\frac{n_{max}}{n}\right)^2 - (P_d - P_{so})\left(\frac{C_v}{Q_d}\right)^2\right)^{-1/2} \tag{3}$$

where $P_{so}$ is the pump "shut off" pressure at its full speed, and $P_d$ and $Q_d$ are the pump pressure and the flow rate at the a duty point.

The signal processor or processing module may be configured to convert an equivalent system characteristics coefficient from motor power and speed using a discrete method, based at least partly on the equation, as follows:

$$C_v = \hat{w}(W, n) \tag{4}$$

where $\hat{w}$ is an inversely remapped discrete function of motor power W based upon their corresponding calibration pump and motor data.

The signal processor or processing module may be configured to receive the signaling, including from a further signal processor configured to process the signals using a 3D sensorless conversion technique.

The signal processor or processing module may be configured to process the signaling using a 3D sensorless conversion technique and generate the signaling.

The apparatus may include, or take the form of, a pump control or controller, including a PID control, having the signal processor or signal processor module, e.g., including for monitoring pump differential pressure and flow.

According to some embodiments, the present invention may takes the form of a method including steps for: processing signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique; and determining equivalent hydronic system characteristics associated with the pump differential pressure and flow rate to their corresponding motor power and speed reconstructed and remapped by using a discrete numerical approach, based at least partly on the signaling received.

The present invention may also, e.g., take the form of a computer program product having a computer readable medium with a computer executable code embedded therein for implementing the method, e.g., when run on a signaling processing device that forms part of such a pump controller. By way of example, the computer program product may, e.g., take the form of a CD, a floppy disk, a memory stick, a memory card, as well as other types or kind of memory devices that may store such a computer executable code on such a computer readable medium either now known or later developed in the future.

BRIEF DESCRIPTION OF THE DRAWING

The drawing includes the following Figures, which are not necessarily drawn to scale:

FIG. 1 is a diagram of a water booster pumping system that is known in the art.

FIG. 2 is a model of a conversion of system pressure and flow rate and motor electrical power and speed for a hydronic pumping system like that shown in FIG. 1.

FIG. 3 is a graph of flow rate, Q (gpm) versus pressure P (Ft or psi) having a pump differential pressure curve at a given speed balanced with system characteristics curve at an equilibrium point.

FIG. 4 shows a 3D discrete distribution function of system flow, pump differential pressure, motor power with respect to motor speed and equivalent system characteristics, respectively.

FIG. 5 includes FIGS. 5*a* and 5*b*, where FIG. 5*a* shows a comparison graph of pump differential pressures (psi) from the sensorless converter (symbols) and a differential pressure sensor (solid lines) versus normalized system coefficient and motor speed, and where FIG. 5*b* shows a comparison graph of flow rates (gpm)) from the sensorless converter (symbols) and a flow meter (solid lines) versus normalized system coefficient and motor speed.

FIG. 6 is a block diagram of apparatus having a signal processor configured for implementing the signal processing functionality, according to some embodiments of the present invention.

DETAILED DESCRIPTION OF THE INVENTION

In general, a pump curve is measured data of pump pressure verse flow rate, which may be expressed approximately as a pressure function P in terms of flow rate Q and motor speed n in a general polynomial form of $P=f_p(Q,n)$, based upon the pump characteristics curve at full speed as well as the affinity laws. For instance for a most practical pumping application, the pump characteristic curve may be written approximately as a second order polynomial pressure function of P as $$P = \left(P_{so} + \frac{P_d - P_{so}}{Q_d^2} Q^2\right)\left(\frac{n}{n_{max}}\right)^2, \tag{1}$$

where $P_{so}$ is the pump shutoff pressure at motor full speed, $P_d$ and $Q_d$ are the pump pressure and flow rate at the duty point in FIG. 3. The second order pressure function may represent most practical pump curves quite accurately. However, one could choose a third or a fourth order function to represent a pump curve as well, if needed, with which Eq. 1 need then to be rewritten accordingly.

By solving the pump characteristics equation of Eq. 1 and the equivalent hydronic system characteristics or dynamic friction coefficient of $C_v$ defined by the flow equation of $C_v=Q/\sqrt{P}$, the pressure equilibrium point at the intersection of the pump and system characteristics curves in the hydronic domain can then be derived in form of $$P(n, C_v) = P_{so}\left(\left(\frac{n_{max}}{n}\right)^2 - (P_d - P_{so})\left(\frac{C_v}{Q_d}\right)^2\right)^{-1} \tag{2}$$

$$Q(n, C_v) = C_v\left(P_{so}\left(\frac{n_{max}}{n}\right)^2 - (P_d - P_{so})\left(\frac{C_v}{Q_d}\right)^2\right)^{-1/2} \tag{3}$$

where $P_{so}$ is pump "shut off" pressure at its full speed, $P_d$ and $Q_d$ are pump pressure and flow rate at its duty point referring to FIG. 3.

The second order pump differential pressure function presented above in Eq. 1 uses two points of pump shut off and duty points on the pump curve at a full motor speed to represent pump differential pressure and associated flow rate at any speed. In general, it may represent most practical pump characteristics, especially for a centrifugal pump. For a better representation with higher accuracy, more points in the pump curve may be utilized to formulate or to best fit a second order function for a pump characteristics curve. For a pump characteristics curve where more than one maximum peak values may be presented, however, a higher order polynomial expression and some numerical approaches may be introduced to solve the problems, if achievable.

For a dynamic hydronic system in which flow rate is regulated by a control valve, the equivalent hydronic system characteristics coefficient $C_v$ is a variable in general. With the input variables of motor speed and power which is the distribution depended upon load at any time, it is a quite challenge as well to formulate the theoretic relationship directly between the motor input variables with their corresponding hydronic variables. In the aforementioned provisional application, a discrete method to convert the equivalent system characteristics coefficient from motor power and speed has been proposed as $$C_v=\hat{w}(W,n), \tag{4}$$

where $\hat{w}$ is the inversely remapped discrete function of motor power W based upon their corresponding calibration pump and motor data, which 3D distribution is plotted in FIG. 4. For a pair of given Wand n motor readouts at an instant time, the unknown equivalent system characteristics variable of $C_v$ in Eq. 4 can be obtained numerically. As a result, the pressure equilibrium point at the intersection of the pump and system curves for the system pressure and flow rate at motor speed and power at any time can therefore be calculated by using Eqs. 2 and 3 directly.

The theoretical and discrete sensorless converter for pump differential pressure and system flow rate has been developed by using Eqs. 2 and 3 together with the system power inversion in Eq. 4. FIG. 5 shows the comparison of the pump differential pressures and flow rates from the sensorless converter and measurement sensors with respect to the normalized system coefficient and motor speed correspondingly. In general, the pump differential pressure values converted are accurate in comparison with the measured ones. The flow rate values converted are however accurate in high speed region and shifted away a little from the measured data at lower speed frequencies.

In this approach, the measured data that may need to be recalibrated is therefore the power distribution of W or $\hat{w}$ in Eq. 4 with respect to the motor speed of n as well as the hydronics system characteristics values of $C_v$ only. There may be no need to recalibrate the converter with a flow meter and/or a pressure sensor, based on the assumption that there should be no significant change to the pump hydronic pressure and flow rate due to aging or wearing, but the efficiency which is associated with the power conversion from the motor power to the pump hydronic one.

The mixed model in Eqs. 2 and 3 may be used for a closed loop system since all energy consumed by the system is from the contribution of system dynamic friction loss and relevant to pump differential pressure only. For an open loop system with a static suction pressure, however, the calibration for the control system may still be feasible in the field with caution.

FIG. 6

By way of example, FIG. 6 shows apparatus 10 according to some embodiments of the present invention, e.g., featuring a signal processor or processing module 10*a* configured at least to:

process signaling containing information about an equilibrium point of pump differential pressure and system pressure formulated in a hydronic domain by utilizing pump and system characteristic curve equations so as to yield system pressure and flow rate at any particular load and time in a pump hydronic system, e.g., using a 3D sensorless conversion technique; and determine equivalent hydronic system characteristics associated with the pump differential pressure and flow rate to their corresponding motor power and speed reconstructed and remapped by using a discrete numerical approach, based at least partly on the signaling processed.

By way of example, the signal processor or processing module 10*a* may form part of a pump controller configured with or as a mixed theoretical and discrete sensorless converter for pump differential pressure and flow, and may includes one or more of the following features:

The mixed theoretical and discrete sensorless converter may include, or take the form of, a pump sensorless converter which yields the pump differential pressure and system flow rate associated with an unknown dynamic system with respect to motor speed and power readout signals based on the pump and system characteristics curves equations as well as the discrete method to convert the equivalent system characteristics coefficient from motor power and speed.

The mixed theoretical and discrete sensorless converter may use the pump differential pressure and flow rate at the equilibrium point of the pump differential pressure curve at a given speed balanced with equivalent hydronic system characteristics curve at a load as represented in Eqs. 2 and 3, and is graphically represented in FIG. 3.

The mixed theoretical and discrete sensorless converter may use a pump curve equation based at least partly on a pump curve model which is developed based upon the pump characteristic equation at any motor speed and system flow rate which may be represented approximately by a polynomial function of $P=f_p(Q,n)$ based upon the full speed characteristics curve and affinity laws. For a practical application example, a second order polynomial function of $$P = P_{so}\left(\frac{n}{n_{max}}\right)^2 + \frac{P_d \cdot P_{so}}{Q_d^2} Q$$

may be used. One may choose a third or a fourth order polynomial function to represent a pump curve as well if needed. For that, the pump curve equation may need then to be re-derived accordingly. For a better representation with a higher accuracy, more points in the pump curve may be utilized to formulate or to best fit a second order function for a pump characteristics curve. For a pump characteristics curve where more than one maximum peak value may be presented, however, a higher order polynomial expression and some numerical approaches may be introduced to solve the problems, if achievable.

The mixed theoretical and discrete sensorless converter may use an equivalent hydronic system characteristics curve equation that includes the flow equation of $C_v=Q/\sqrt{P}$ or some of its approximations.

The mixed theoretical and discrete sensorless converter may use a pressure equilibrium point that includes the intersection of the pump curve as well as the system curve as shown FIG. 3. The pressure equilibrium point for the system pressure and flow rate at any motor speed and power can be represented in Eqs. 2 and 3 for a second order pump curve approximation. For some other functions to represent a pump curve if needed, the pressure equilibrium point for the system pressure and flow rate at any motor speed and power may be represented in some other form by following the pressure equilibrium point approach.

The mixed theoretical and discrete sensorless converter may use a discrete conversion to the equivalent system characteristics coefficient from motor power and speed that includes an inversely remapped discrete function of $\hat{w}$ from a motor power distribution of W with respect to motor speed and an equivalent system curve based upon their corresponding calibration pump and motor data plotted in FIG. 4.

The mixed theoretical and discrete sensorless converter may use a discrete conversion of remapping and reconstruction that includes all potential 3D discrete numerical remapping methods, such as 2D interpolations, 2D Splines, and so forth.

The mixed theoretical and discrete sensorless converter may use a conversion that includes all potential 2D or 3D discrete or numerical inversion methods, such as 1D or 2D direct inversion, minimizations, simplex, and so forth.

The mixed theoretical and discrete sensorless converter may use a pumping hydronic system that includes all close loop or open loop hydronic pumping systems, such as primary pumping systems, secondary pumping systems, water circulating systems, and pressure booster systems. The systems mentioned here may consist of a single zone or multiple zones.

The mixed theoretical and discrete sensorless converter may use pump calibration data for a close loop hydronic system that includes pump differential pressure and flow rate data, since all energy consumed by the system is from the contribution of system dynamic friction loss, which is only relevant to the pump differential pressure. The calibration data may include the system pressure data or pump discharge section pressure and the corresponding flow rate.

The mixed theoretical and discrete sensorless converter may use pump calibration data for an open loop hydronic system that includes the pump differential pressure or system pressure and flow rate with respect to the corresponding motor data. For an open loop system with a static suction pressure, the system pressure data and flow rate may be obtained directly in the field. For an open loop system with a varying suction pressure, however, one pressure sensor at the pump suction side or a differential pressure sensor at the pump may be used to calibrate the pressure and flow rate contributions from the suction pressure.

The mixed theoretical and discrete sensorless converter may use measured motor data that includes any pair of potential motor electrical or mechanical readout signals such as motor speed, current, torque, power, and so forth.

The mixed theoretical and discrete sensorless converter may use hydronic signals that may include system pressure, pump differential pressure, zone pressures, system flow rates, zone flow rates, and so forth.

The mixed theoretical and discrete sensorless converter may include providing control signals via transmitting and wiring technologies that may include all conventional sensing and transmitting means that are used currently. Preferably, wireless sensor signal transmission technologies would be optimal and favorable.

The mixed theoretical and discrete sensorless converter may use pumps for the hydronic pumping systems that may include a single pump, a circulator, a group of parallel ganged pumps or circulators, a group of serial ganged pumps or circulators, or their combinations.

The mixed theoretical and discrete sensorless converter may use systems flow regulation that may include manual or automatic control valves, manual or automatic control circulators, or their combinations.

The Apparatus 10

By way of example, the functionality of the apparatus 10 may be implemented using hardware, software, firmware, or a combination thereof. In a typical software implementation, the apparatus 10 would include one or more microprocessor-based architectures having, e.g., at least one signal processor or microprocessor like element 10*a*. A person skilled in the art would be able to program such a microcontroller-based, or microprocessor-based, implementation to perform the functionality described herein without undue experimentation. For example, the signal processor or processing module 10*a* may be configured by a person skilled in the art without undue experimentation to process signaling containing information about an equilibrium point of pump differential pressure and system pressure formulated in a hydronic domain by utilizing pump and system characteristic curve equations so as to yield system pressure and flow rate at any particular load and time in a pump hydronic system, e.g., using a 3D sensorless conversion technique, consistent with that set forth in the aforementioned patent application Ser. No. 14/091,795. Moreover, the signal processor or processing module 10*a* may be configured by a person skilled in the art without undue experimentation to determine equivalent hydronic system characteristics associated with the pump differential pressure and flow rate to their corresponding motor power and speed reconstructed and remapped by using a discrete numerical approach, based at least partly on the signaling processed, consistent with that disclosed herein.

The scope of the invention is not intended to be limited to any particular implementation using technology either now known or later developed in the future. The scope of the invention is intended to include implementing the functionality of the processors 10*a* as stand-alone processor or processor module, as separate processor or processor modules, as well as some combination thereof.

The apparatus may also include other signal processor circuits or components 10*b*, e.g. including random access memory (RAM) and/or read only memory (ROM), input/output devices and control, and data and address buses connecting the same, and/or at least one input processor and at least one output processor.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. Apparatus comprising:

a signal processor or processing module configured at least to:

process signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique; and determine corresponding signaling containing information about equivalent hydronic system characteristics associated with the pump differential pressure and flow rate to their corresponding motor power and speed reconstructed and remapped by using a discrete numerical approach, based at least partly on the signaling processed, the signal processor or processing module configured to use an equivalent hydronic system characteristics curve equation that includes a flow equation of $C_v=Q/\sqrt{P}$, or at least some of its approximations.

2. Apparatus according to claim 1, wherein the signal processor or processing module is configured to provide the corresponding signaling containing information about the equivalent hydronic system characteristics determined, including the pump differential pressure and flow rate for monitoring.

3. Apparatus according to claim 2, wherein the corresponding signaling contains information used to control the pumping hydronic system.

4. Apparatus according to claim 3, wherein the corresponding signaling is provided for systems flow regulation that includes manual or automatic control valves, manual or automatic control circulators, or their combinations.

5. Apparatus according to claim 1, wherein the signal processor or processing module is configured to receive motor power and speed readout signaling containing information about motor power and speed and convert the equivalent hydronic system characteristics from the motor power and speed readout signaling received.

6. Apparatus according to claim 1, wherein the signal processor or processing module is configured to balance the pump differential pressure and flow rate at the equilibrium point of a pump differential pressure curve at a given speed with the equivalent hydronic system characteristics at a given load.

7. Apparatus according to claim 1, wherein the signal processor or processing module is configured to use a pump curve equation based at least partly on a pump curve model which was developed based upon a pump characteristic equation at any motor speed and system flow rate which may be represented approximately by a polynomial function of $P=f_p(Q,n)$ based upon a full speed characteristics curve and affinity laws.

8. Apparatus according to claim 7, wherein the polynomial function includes a second order polynomial function of $$P = P_{so}\left(\frac{n}{n_{max}}\right)^2 + \frac{P_d \cdot P_{so}}{Q_d^2} Q, \tag{1}$$

where $P_{so}$ is a pump shutoff pressure at motor full speed, and $P_d$ and $Q_d$ are a pump pressure and a flow rate at a duty point.

9. Apparatus according to claim 7, wherein the polynomial function includes a third or a fourth order polynomial function to represent the pump curve equation.

10. Apparatus according to claim 9, wherein the signal processor or processing module is configured to re-derive the pump curve equation accordingly.

11. Apparatus according to claim 1, wherein the signal processor or processing module is configured to determine a pressure equilibrium point that includes an intersection of a pump curve as well as a system curve.

12. Apparatus according to claim 11, wherein the pressure equilibrium point for the system pressure and flow rate at any motor speed and power is based at least partly on a second order pump curve approximation.

13. Apparatus according to claim 1, wherein the signal processor or processing module is configured to use a discrete conversion to an equivalent system characteristics coefficient from the corresponding motor power and speed that includes an inversely remapped discrete function of $\hat{w}$ from a motor power distribution of W with respect to motor speed and an equivalent system curve based upon corresponding calibration pump and motor data plotted.

14. Apparatus according to claim 1, wherein the signal processor or processing module is configured to use a discrete conversion of remapping and reconstruction that includes one or more 3D discrete numerical remapping methods, including 2D interpolations or 2D Splines.

15. Apparatus according to claim 1, wherein the signal processor or processing module is configured to use a discrete conversion of remapping and reconstruction that includes one or more 2D or 3D discrete or numerical inversion methods, including 1D or 2D direct inversion, minimizations or simplex.

16. Apparatus according to claim 1, wherein the signal processor or processing module is configured to use for the pumping hydronic system one or more close loop or open loop hydronic pumping systems, including primary pumping systems, secondary pumping systems, water circulating systems, and pressure booster systems.

17. Apparatus according to claim 16, wherein the pumping hydronic system includes a single zone or multiple zones.

18. Apparatus according to claim 1, wherein the signal processor or processing module is configured to use pump calibration data for a close loop hydronic system that includes pump differential pressure and flow rate data.

19. Apparatus according to claim 18, wherein the pump calibration data includes either system pressure data or pump discharge section pressure and corresponding flow rate data.

20. Apparatus according to claim 1, wherein the signal processor or processing module is configured to use pump calibration data for an open loop hydronic system that includes the pump differential pressure or system pressure and flow rate with respect to corresponding motor data.

21. Apparatus according to claim 20, wherein, for an open loop system with a static suction pressure, the signal processor or processing module is configured to receive associated signaling containing information about system pressure and flow rate data obtained.

22. Apparatus according to claim 20, wherein, for an open loop system with a varying suction pressure, the signal processor or processing module is configured to receive associated signaling from one pressure sensor at a pump suction side or a differential pressure sensor at the pump that may be used to calibrate pressure and flow rate contributions from suction pressure.

23. Apparatus according to claim 1, wherein the signal processor or processing module is configured to use measured motor data that includes some pair of potential motor electrical or mechanical readout signals, including motor speed, current, torque, or power.

24. Apparatus according to claim 1, wherein the signal processor or processing module is configured to process hydronic signals that include system pressure, pump differential pressure, zone pressures, system flow rates, or zone flow rates.

25. Apparatus according to claim 1, wherein the signaling received contains information related to a pump that includes a single pump, a circulator, a group of parallel ganged pumps or circulators, a group of serial ganged pumps or circulators, or some combination thereof.

26. Apparatus according to claim 25, wherein the apparatus comprises the pump hydronic system.

27. Apparatus according to claim 1, wherein the signal processor or processing module is configured to receive the signaling, including from a further signal processor configured to process the signals using a 3D sensorless conversion technique.

28. Apparatus according to claim 1, wherein the signal processor or processing module is configured to process the signaling using a 3D sensorless conversion technique.

29. Apparatus comprising:

a signal processor or processing module configured at least to:

process signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique; and determine corresponding Signaling containing information about equivalent hydronic system characteristics associated with the pump differential pressure and flow rate to their corresponding motor power and speed reconstructed and remapped by using a discrete numerical approach, based at least Partly on the signaling processed, wherein the signal processor or processing module is configured to determine a pump characteristic curve based at least partly on a pump characteristics equation, as follows:

$$P = P_{so}\left(\frac{n}{n_{max}}\right)^2 + \frac{P_d \cdot P_{so}}{Q_d^2} Q, \tag{1}$$

where $P_{so}$ is a pump shutoff pressure at motor full speed, and $P_d$ and $Q_d$ are a pump pressure and a flow rate at a duty point.

30. Apparatus according to claim 29, wherein the signal processor or processing module is configured to determine an equivalent hydronic system characteristics or dynamic friction coefficient of $C_v$, based at least partly on a flow equation, as follows:

$$C_v = Q/\sqrt{P},$$

31. Apparatus according to claim 30, wherein the signal processor or processing module is configured to determine a pressure equilibrium point at an intersection of the pump and system characteristic curves in the hydronic domain based at least partly on solving equations, as follows:

$$P(n, C_v) = P_{so}\left(\frac{n}{n_{max}}\right)^2\left[1 - (P_d - P_{so})\left(\frac{C_v}{Q_d}\right)^2\right]^{-1} \tag{2}$$

$$Q(n, C_v) = C_v\left(\frac{n}{n_{max}}\right)\left[P_{so} \Big/ \left(1 - (P_d - P_{so})\left(\frac{C_v}{Q_d}\right)^2\right)\right]^{-1/2}, \tag{3}$$

where $P_{so}$ is the pump "shut off" pressure at its full speed, and $P_d$ and $Q_d$ are the pump pressure and the flow rate at the a duty point.

32. Apparatus according to claim 31, wherein the signal processor or processing module is configured to convert an equivalent system characteristics coefficient from motor power and speed using a discrete method, based at least partly on an equation, as follows:

$$C_v = \hat{w}(W, n), \tag{4}$$

where $\hat{w}$ is an inversely remapped discrete function of motor power W based upon their corresponding calibration pump and motor data.

33. Apparatus according to claim 29, wherein the signal processor or processing module is configured to provide the corresponding signaling containing information about the equivalent hydronic system characteristics determined, including the pump differential pressure and flow rate for monitoring.

34. Apparatus according to claim 33, wherein the corresponding signaling contains information used to control the pumping hydronic system.

35. Apparatus according to claim 29, wherein the signal processor or processing module is configured to receive motor power and speed readout signaling containing information about motor power and speed and convert the equivalent hydronic system characteristics from the motor power and speed readout signaling received.

36. Apparatus according to claim 29, wherein the signal processor or processing module is configured to balance the pump differential pressure and flow rate at the equilibrium point of a pump differential pressure curve at a given speed with the equivalent hydronic system characteristics at a given load.

37. Apparatus according to claim 29, wherein the signal processor or processing module is configured to use a pump curve equation based at least partly on a pump curve model which was developed based upon a pump characteristic equation at any motor speed and system flow rate which may be represented approximately by a polynomial function of $P=f_p(Q,n)$ based upon a full speed characteristics curve and affinity laws.

38. A method comprising:

processing in a signal processor or processing module signaling containing information about an equilibrium point of pump differential pressure and system pressure formulated in a hydronic domain by utilizing pump and system characteristic curve equations so as to yield system pressure and flow rate at any particular load and time in a pump hydronic system, including using a multi-dimensional sensorless conversion technique; and determining in the signal processor or processing module corresponding signaling containing information about equivalent hydronic system characteristics associated with the pump differential pressure and flow rate to their corresponding motor power and speed reconstructed and remapped by using a discrete numerical approach and by also using an equivalent hydronic system characteristics curve equation that includes a flow equation of $C_v=Q/\sqrt{P}$, or at least some of its approximations, based at least partly on the signaling received.

39. A method according to claim 38, wherein the method comprises providing the corresponding signaling containing information about the system pumping flow rate and pressure determined.

40. A method according to claim 39, wherein the corresponding signaling contains information used to control the pumping hydronic system.

* * * * *